US011454115B2

(12) United States Patent
Bergqvist et al.

(10) Patent No.: US 11,454,115 B2
(45) Date of Patent: Sep. 27, 2022

(54) METHOD AND SYSTEM FOR ENSURING THE QUALITY OF A MULTI-COMPONENT MIXTURE FOR ROCK REINFORCEMENT

(71) Applicant: EPIROC ROCK DRILLS AKTIEBOLAG, Örebro (SE)

(72) Inventors: Viktor Bergqvist, Vintrosa (SE); Martin Ekefalk, Kumla (SE); Johan Engblom, Nora (SE); Lennart Gürlet Häggström, Vintrosa (SE); Jan Olsson, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 16/644,235

(22) PCT Filed: Oct. 19, 2018

(86) PCT No.: PCT/SE2018/051071
§ 371 (c)(1),
(2) Date: Mar. 4, 2020

(87) PCT Pub. No.: WO2019/083430
PCT Pub. Date: May 2, 2019

(65) Prior Publication Data

US 2021/0108514 A1 Apr. 15, 2021

(30) Foreign Application Priority Data

Oct. 27, 2017 (SE) ..... 1751331-8

(51) Int. Cl.
*E21D 20/00* (2006.01)
*E21D 9/00* (2006.01)
*E21D 20/02* (2006.01)

(52) U.S. Cl.
CPC ..... *E21D 9/001* (2013.01); *E21D 20/028* (2013.01)

(58) Field of Classification Search
CPC ..... E21D 9/001; E21D 20/028; E21D 20/003; E21D 20/025; E21D 21/0026;
(Continued)

(56) References Cited

U.S. PATENT DOCUMENTS 3,920,223 A * 11/1975 Krueger ..... B01F 27/923 261/DIG. 26
3,930,639 A * 1/1976 Steinberg ..... E21D 20/028 405/259.6

(Continued)

FOREIGN PATENT DOCUMENTS

CN 101495931 A 7/2009
CN 103221893 A 7/2013

(Continued)

OTHER PUBLICATIONS

International Search Report and Written Opinion in corresponding International Application No. PCT/SE2018/051071 dated Jan. 4, 2019 (9 pages).

(Continued)

*Primary Examiner* — Edwin J Toledo-Duran
(74) *Attorney, Agent, or Firm* — Sage Patent Group

(57) ABSTRACT

A method for ensuring the quality of a multi-component mixture in a system for rock reinforcement is described herein. The system comprises a first and a second channel for a respective first and second component intended for injection in a rock hole. The respective channel comprises a pump and a container intended for the respective component. The method comprises the steps of pumping of the respective component from the respective container through the respective channel and continuously comparing the flow (Continued)

of the first component in the first channel with the flow of the second component in the second channel. The method further comprises the step of controlling the pumps individually, based on the comparison of the flows, in such a way that a deviation from a pre-defined volume ratio between the first component and the second component in the mixture is below a pre-defined first threshold.

11 Claims, 3 Drawing Sheets

(58) Field of Classification Search
CPC ... E21D 21/008; E21D 21/00; E21D 21/0033; E21D 21/0086; E21D 20/026; E21D 21/004; E21D 20/00; E21D 20/02; E21D 20/021; E21D 21/0006; E21D 21/0046; E21D 21/006; E21D 21/0093; E21D 20/006; E21D 21/0053; E21D 21/02; E21D 11/152; E21D 20/023; E21D 21/0013; E21D 23/03; E21D 11/006; E21D 11/155; E21D 17/006; E21D 17/01; E21D 19/04; E21D 21/0073; E21D 23/0052; E21D 23/24; E02D 5/80; E02D 5/801; E02D 5/808; E02D 3/00; E02D 3/12; E02D 27/50; E02D 7/22; E02D 17/20; E02D 29/0233; E02D 5/56; E02D 17/18; E02D 17/207; E02D 2250/003; E02D 29/02; E02D 29/0241; E02D 3/02; E02D 5/803; E02D 5/805; E02D 7/02; E02D 17/205; E02D 1/02; E02D 2300/00; E02D 2300/0003; E02D 2300/0006; E02D 2300/002; E02D 2300/0026; E02D 2300/0079; E02D 2600/40; E02D 27/00; E02D 27/32; E02D 27/34; E02D 27/40; E02D 29/0216; E02D 29/025; E02D 31/06; E02D 31/08; E02D 31/10; E02D 3/08; E02D 5/02; E02D 5/03; E02D 5/04; E02D 5/06; E02D 5/08; E02D 5/16; E02D 5/385; E02D 5/46; E02D 5/54; E02D 5/62; E02D 5/765; E02D 7/06; E02D 7/24
USPC ..... 405/259.1, 259.5, 259.6, 302.1, 302.4
See application file for complete search history.

(56) References Cited

U.S. PATENT DOCUMENTS 4,120,369 A * 10/1978 Fischer ..... E21B 21/003 166/292
4,229,124 A * 10/1980 Frey ..... E21D 20/028 405/303
4,509,903 A * 4/1985 Fram ..... F04B 19/027 74/105
4,974,689 A * 12/1990 Issakainen ..... E21D 9/001 299/11
6,793,445 B1 * 9/2004 Charlton ..... E21D 20/028 405/303
8,753,041 B2 * 6/2014 Gray ..... E21D 20/028 405/259.1
9,175,561 B2 * 11/2015 Brown ..... E21D 20/003
9,499,951 B2 * 11/2016 Levey ..... E02D 7/24
10,253,628 B2 4/2019 Faulkner et al.
10,747,240 B1 * 8/2020 Surjaatmadja ..... F04B 23/04
2004/0057853 A1 * 3/2004 Ross ..... F04B 23/06 417/426
2007/0264088 A1 11/2007 Richter
2007/0297862 A1 * 12/2007 Giraldo ..... E21D 21/004 405/259.1
2009/0052995 A1 * 2/2009 Eriksson ..... E21D 20/028 405/259.5
2010/0183379 A1 * 7/2010 Simmons ..... B65B 29/10 405/259.5
2011/0070035 A1 * 3/2011 Ricardo ..... E21D 20/028 405/259.5
2012/0020744 A1 * 1/2012 Eigemann ..... E21D 20/028 285/119
2012/0048009 A1 * 3/2012 berg ..... E21D 20/028 73/152.51
2012/0177448 A1 * 7/2012 Steyn ..... E21D 20/028 405/259.5
2014/0140773 A1 * 5/2014 Brown ..... E21D 20/028 405/259.5
2017/0296727 A1 * 10/2017 Burbank ..... A61M 1/1605
2017/0354941 A1 * 12/2017 Brown ..... B01F 25/30
2018/0031462 A1 * 2/2018 Dwarakanath ..... E21B 43/26
2018/0066519 A1 * 3/2018 Faulkner ..... E21D 20/028
2018/0291737 A1 * 10/2018 Pastorino ..... E21D 20/028

FOREIGN PATENT DOCUMENTS

CN 103867176 A 6/2014
CN 104245321 A 12/2014
CN 106248545 A 12/2016
NO 319141 B1 6/2005
RU 2021522 C1 10/1994
RU 2134350 C1 8/1999
SU 998765 A1 2/1983
SU 1262051 A1 10/1986
WO 2009079684 A1 7/2009
WO 2012171056 A1 12/2012
WO 2016141008 A1 9/2016

OTHER PUBLICATIONS

Chinese First Office Action and Search Report in corresponding Chinese Application No. 201880069587.8 dated Jan. 12, 2021 (6 pages).
Russian Office Action and Search Report in corresponding Russian Application No. 2020111562/03(019523) dated Dec. 1, 2021 (9 pages).

* cited by examiner

METHOD AND SYSTEM FOR ENSURING THE QUALITY OF A MULTI-COMPONENT MIXTURE FOR ROCK REINFORCEMENT

CROSS-REFERENCE TO RELATED APPLICATIONS

This application is a U.S. National Stage application of PCT/SE2018/051071, filed Oct. 19, 2018 and published on May 2, 2019 as WO/2019/083430, which claims the benefit of Swedish Patent Application No. 1751331-8, filed Oct. 27, 2017, all of which are hereby incorporated by reference in their entireties.

TECHNICAL FIELD

The present invention relates to the mining industry. The invention particularly concerns a method and a system at rock reinforcement, e.g. in conjunction with tunnelling.

BACKGROUND

In conjunction with tunnelling or in mining there may often arise cracks in the rock layers around cavities, e.g. at holes where a future tunnel shall pass. These cracks weaken the rock, which may lead to parts of the rock collapsing. There is thus a need for measures which reduces the risk of collapse. Such measures are usually called rock reinforcement. A common method for rock reinforcement is rock bolting. One type of rock bolting implicate a bolt being fastened in a drilled hole by means of a molding agent. A hole is therefore first drilled in the rock. The drilling may be performed by a drill or by means of a self-drilling rock bolt. A self-drilling rock bolt is a bolt with a drill bit fixedly mounted or fixedly welded thereto. The hole in the rock is thus drilled by means of the self-drilling bolt.

After the hole in the rock has been drilled a rock bolt is placed in the hole. If the hole was drilled by a self-drilling rock bolt, then the bolt is already placed in the hole when the drilling is finished. The bolt is thereafter anchored to the rock by means of a molding agent which is injected in the hole in the rock. The molding agent sets, or solidifies, within the hole in the rock around the rock bolt, as well as in crevices debouching from the hole in the rock into the rock. In this way the rock bolt is anchored to the hole in the rock. The molding agent is injected in the hole by means of a system adapted to be used in rock reinforcement. A self-drilling bolt may comprise a channel within the bolt through which the molding agent may be injected in the rock hole. The rock bolt may thus be hollow such that the molding agent may be injected through the rock bolt and out through a drill bit at the furthest end of the bolt.

The molding agent may for example be a component mixture which may at least comprise two components, a first component and a second component, intended for rock reinforcement. The first component may comprise a catalyst for expediting the setting, which may also be called a hardener, such as e.g. sodium metasilicate, an alcohol, a polyol or similar, or a combination of these. The second component may comprise a resin such as e.g. methylene diphenyl diisocyanate (MDI) or similar.

The first component and the second component are intended to be mixed with each other when injected in the rock hole, such that a mixture is created. The mixture may be created by means of a mixer through which the two components are injected in the rock hole. The components are mixed in the mixer before, or at the same time as, they are brought into the hole. When the components have been mixed together a reaction occurs in the resin which is triggered by the hardener and which leads to cross-links being created in the resin resulting in the mixture hardening.

As have been mentioned, the component mixture that is created may be injected through a cavity in the rock bolt. The rock hole may thus be filled with component mixture from the bottom of the rock hole. The molding agent fills the hole around the bolt and will also penetrate into crevices in the rock. In this way the rock layers are bound and held together such that the risk for collapse is reduced. The molding agent also serves to protect the bolt from influences from the environment, such as e.g. corrosion.

It is thus of utmost importance that the reinforcement is of adequately good quality so that the risk of collapse is minimized. Tensile tests may be performed in order to control the reinforcement, but are for economical and practical reasons performed on a very limited number of the rock reinforcements that are performed.

US 2011/0070035 describes a device for use at rock reinforcement. The device comprises a self-drilling rock bolt comprising a fluid injector with channels for water and two molding components. The components are injected by means of pumps that can be controlled to achieve a desired distribution of these components.

WO 2016/141008 also describes a device for use at rock reinforcement where two reservoirs for components are connected through channels to a drill hole for injection of the components. Individual pumps are arranged for the two components. The flow through the pumps is calibrated to achieve a specific distribution of the components, which distribution may be 4:1 to 3:2. The calibration may e.g. be performed by adapting the inlet air pressure and the diameter of the outlet of the component channels.

Thus, the quality of the mixture in the rock hole is of great importance as the molding agent must have a high strength. The components are often kept separated all the way up to the mouth of the rock hole, where the mixing is performed just before or in conjunction with the injection in the rock hole. There is today a need to ensure the quality of the mixture being injected in the rock hole.

SUMMARY

An object of the present invention is therefore to ensure that the quality of the mixture being injected in a rock hole at rock reinforcement.

The object is achieved according to a first aspect of the invention by a method for ensuring the quality of a multi-component mixture comprising at last two components in a system for rock reinforcement. The system comprises a first and a second channel for a respective first and second component intended for injection in a rock hole. The respective channel comprises a pump and a container intended for the respective component. The respective component is pumped from the respective container through the respective channel. When pumping, the flow of the first component in the first channel is continuously compared with the flow of the second component in the second channel. The pumps are controlled individually, based on the comparison of the flows, in such a way that a deviation from a pre-defined volume ratio between the first component and the second component in the mixture is below a pre-defined first threshold.

The above mentioned object is also achieved according to a second aspect of the invention by a system for ensuring the quality of a multi-component mixture comprising at least two components for use in rock reinforcement. The system comprises a first and a second channel for a respective first and second component intended for injection in a rock hole. The respective channel comprises a pump and a container intended for the respective component. The pumps are intended to pump the respective component from the respective container through the respective channel. The system comprises flow meters arranged in the respective first and second channel and a control unit configured to continuously compare the flow of said first component in said first channel to the flow of said second component in said second channel. The control unit is further configured to control the pumps individually in such a way that a deviation from a pre-determined volume ratio between the first component and the second component in the mixture is below a pre-determined first threshold.

By continuously comparing the flow of the first component in the first channel with the flow of the second component in the second channel, and individually control the pumps such that a deviation from a pre-determined volume ratio between the first component and the second component in the mixture is below a pre-determined first threshold, the volume ratio between the two components may be kept within a certain margin of error. In this way it is achieved that the mixture being injected in the rock hole consist of a component mixture having a desired volume ratio between the at least two components. A correct volume ratio between the components provides an optimal setting of the mixture. Thus, through the above described method and system it is achieved that the quality of the mixture is ensured.

Furthermore, since the pumps are controlled individually based on the flow comparison between the channels, a reduced flow in one of the channels will automatically result in the flow in the other channel being reduced by the control unit down-regulating the pump in that channel. In this way a volume ratio may be maintained even if individual changes of the flow occurs in either of the channels during operation, e.g. because of an obstruction in a channel or a deterioration of the pump. In this way it is achieved that the quality of the mixture can be ensured even when unexpected events occur during operation, i.e. under dynamical conditions.

Consequently, a system and a method ensuring the quality of the mixture being injected in a rock hole at rock reinforcement are provided.

BRIEF DESCRIPTION OF THE DRAWINGS

Additional objects and advantages to, as well as features of, the invention will be apparent from the following detailed description of one or several embodiments provided with reference to the accompanying drawings, in which.

DETAILED DESCRIPTION

The embodiments herein will now be described in more detail with reference to the accompanying drawings, in which example embodiments are shown. The invention should not be construed as limited by the disclosed examples of embodiments. Like numbers refer to like elements throughout.

Figure 1:
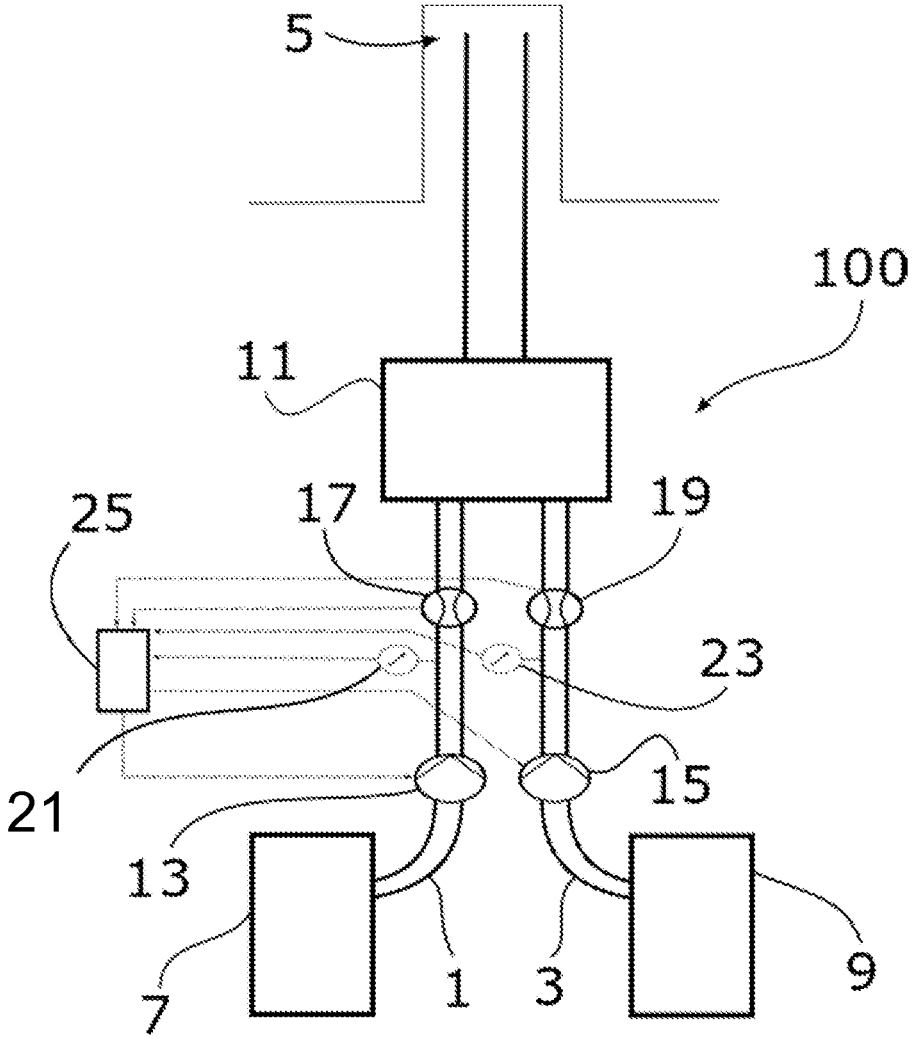
FIG. 1 shows a schematic perspective view of an exemplifying system 100 in rock reinforcement.

FIG. 1 illustrates an exemplifying system for ensuring the quality of a multi-component mixture comprising at least two components for use in rock reinforcement, wherein the system 100 comprises a first channel 1 and a second channel 3 for a first component A and a second component B intended for injection in a rock hole 5. The respective channels 1, 3 in the system 100 comprises a first pump 13 and a second pump 15 as well as a first container 7 intended for the first component A and a second container 9 intended for the second component B. Said pumps 13, 15 are intended to pump the respective component A, B from the respective container 7, 9 through the respective channel 1, 3.

The two components A, B are pumped in their respective channels 1, 3 to an injection adapter where the components are mixed in a mixer 11 just before the component mixture is pressed into the bolt and fills the rock hole 5 from the bottom or from the mouth. The mixer may e.g. be a static mixer. The components A, B are thus completely separated up until the injection adapter which makes the components meet at the inlet to the mixer 11. In some embodiments, the injection adapter is inwardly arranged as a Y-cross. With Y-cross is herein meant that the channels 1, 3 converge, in the injection adapter, at a certain angle into a common channel. The components A, B may pass a respective check valve (not shown) with a specific opening pressure, e.g. 15 bar, and thereafter converge, e.g. similar to the letter Y, directly into the mixer 11. Other arrangements of the channel section where the components meet in the injection adapter are naturally possible, the channels may e.g. meet in the shape of a T etc.

The system 100 further comprises flow meters 17, 19 arranged in the first 1 and second 3 channel respectively, as well as a control unit 25 configured to continuously compare the flow of said first component A in said first channel 1 with the flow of said second component B in said second channel 3. The control unit 25 is further configured to control the pumps 13, 15 individually such that a deviation from a pre-determined volume ratio between the first component A and the second component B in the mixture is below a pre-determined first threshold.

By measuring the flow in the respective channels 1, 3 and controlling the pumps 13, 15 individually based on a comparison between the flow in the channels 1, 3 the system 100 can ensure that a specific volume ratio between the components in the component mixture is maintained. The quality of the component mixture is important in order to achieve a rock reinforcement with a high strength. The quality of the final mixture is amongst other things affected by the volume ratio of the components A, B in the mixture. By continuously measuring the flow and individually controlling the pumps 13, 15 the system 100 can dynamically ensure that the volume ratio is maintained even when unexpected events occur. If, for example, the flow decreases in one of the channels 1, 3, e.g. because of an obstruction in the channel 1, 3 or an unexpected deterioration of the pump 13, 15 of that channel 1, 3, then the flow in the other channel 3, 1 will automatically decrease. Furthermore, different components A, B can be used without recalibrating the system 100 since the control is based on the flow, which means that e.g. different viscosity or temperature of the components A, B will not influence the volume ratio in the mixture.

By "continuously compare" is in the present disclosure meant a comparison which is performed either several times during the injection procedure, i.e. the flow is measured at several separate occasions, or that the measurement is performed constantly, i.e. coherently, during the entire injection procedure.

The first component A may comprise a catalyst to expedite the setting, also referred to herein as a hardener, such as e.g. sodium metasilicate, an alcohol, a polyol or similar, or a combination of these. The second component may comprise a resin such as e.g. methylene diphenyl diisocyanate (MDI). The components A and B may also be referred to as resin components or resin liquids.

The pre-determined volume ratio between the component A and B may e.g. be 1:1 and the pre-determined first threshold may e.g. be a percentage of deviation from this ratio within the interval 1-15%. The pre-determined first threshold is according to a preferred embodiment a percentage of deviation of 5%. Other ratios between the volumes of the components A, B are also possible, e.g. 2:1, 1:2, 3:1 etc. The desired volume ratio may e.g. depend on what components A and B that are going to be mixed. The flow meters 17, 19 are preferably arranged directly after the respective pumps 13, 15. The flow meters 17, 19 may be adapted specifically for the components A, B, e.g. by being arranged in such a way that they are resilient to aggressive liquids or chemicals. Thus, an increased life time of the flow meters 17, 19 in the system 100 is achieved. The signals of the flow meters 17, 19 may be used both in order to regulate a correct flow and also to be able to detect a fault, which will be described in more detail below. The flow meters 17, 19 may be arranged downstream of the containers 7, 9 and the pumps 13, 15, but upstream of the mixer 11 in the direction of flow of the components in the respective channel 1, 3. By being arranged upstream of the mixer 11, i.e. before the components are mixed, the flow in each channel may thus be measured individually.

According to some embodiments the control unit 25 is further configured to also control the pumps 13, 15 according to a set-point of the flow of the components A, B. The system 100 may further comprise means for monitoring of a parameter related to the operation of the respective pumps 13, 15, wherein the control unit 25 is further configured to adjust the set-point of the flow when at least one of the monitored parameters coincide with a pre-determined second threshold.

The set-point of the flow may be determined based on the volume of the rock hole 5 which is to be filled and the setting time of the component mixture at hand. The setting time may e.g. be between 20 seconds and 5 minutes. If the volume which is pumped in is too great, component mixture which has not set may drip or flow out of the rock hole, and if the flow is too small the component mixture may set before the hole 5 has had time to be filled which complicates the filling of the hole 5. In the latter case the rock bolting is impaired and may in the worst case scenario lead to the rock reinforcement being prematurely aborted and consequently that a new rock reinforcement must be initiated.

The monitored parameters may be related to the load of the pumps 13, 15. The monitored parameters may e.g. be the current modulation to the directional valves for the oil flow of a hydraulic motor which controls the pumps 13, 15 in the case when a hydraulic motor controls the pumps 13, 15. The current modulation will in that case be monitored directly by a current regulator. The control unit 25 may e.g. be configured to step down or reduce the set-point of the flow as soon as the monitored parameter coincides with a pre-defined threshold. For example when one of the current regulators achieves a certain modulation, e.g. 80% of the maximum current modulation to the valves. This is performed in order to precede a reduced flow because of an increased back pressure and thereby a worsened volume ratio between the components A, B. The volume ratio between the components A, B is thus maintained by decreasing the flow in both channels 1, 3. This is e.g. advantageous when one of the pumps 13, 15 during regulation is approaching its maximum capacity, which may be a consequence of the channel at hand starting to clog up. By downregulating both pumps 13, 15 it is avoided that the pump reaches its maximum capacity which would result in the volume ratio between the components A, B in the mixture changing. Furthermore, overloading of the pumps 1, 3 is avoided. That the volume ratio is correct may thus be prioritized over the flow having an optimal value. Another example of a monitored parameter may be the current to an electric motor which controls the pumps 13, 15 in the case when a hydraulic motor is controlling the pumps 13, 15. Other examples of parameters that are monitored may be the pressure in the channels 1, 3, the flow in the channels 1, 3 and the volume ratio between the components A, B.

Downregulation may e.g. be performed in pre-defined steps, e.g. in step of 0.2 l/min. The system 100 may after a duration of time try to step up the set-point again in order to achieve an optimal filling time in the rock hole. In order to avoid swings in the system, the upregulation may preferably be performed slower than the downregulation. The upregulation may e.g. be performed in steps of a different magnitude than the downregulation, e.g. in steps of 0.1 l/min.

According to some embodiments the containers 7, 9 may comprise air inlets arranged to replace the volume of the components which have been pumped out of the respective container 7, 9 with dry air.

During injection of the components A, B in the rock hole 5 the pumps 13, 15 will suck component liquid A, B out of the containers 7, 9 which will result in the liquid level or component level in the container 7, 9 dropping. To compensate for the loss of liquid the respective container 7, 9 may be refilled with air. The containers 7, 9 may be refilled with dry air through an air drying system in order to minimize the risk of humid air reaching the inside of the containers 7, 9 and reacting with the liquids A, B. The air drying system may in a known manner cool the air to ambient temperature and thereby remove any potential free water through condensation. The air drying system may also remove particles such as oil-particles through filtering by means of a filter. The air drying system may also lead the air through a membrane-dryer which will lower the relative humidity (RH) from e.g. 100% to 7%. The air drying system may thus achieve air with 7% RH at 14° C. The air drying system may e.g. be arranged on a rig. Alternatively, the containers 7, 9 may be refilled with air through an air filter which ensures that the air is dry.

By arranging the system 100 in this way, it is avoided that humid air reaches the components A, B in the containers 7, 9 and start a hardening reaction which would influence both the system 100 and the quality of the component mixture in a negative way. By replacing the volume of the components which have been pumped out of the respective container 7, 9 with dry air it is achieved that the quality of the mixture is ensured.

The dry air may be brought into the upper part of the respective containers 7, 9 such that the containers 7, 9 are filled with air from above the level of the component A, B in the container 7, 9. The containers 7, 9 may be mounted higher than the pumps 13, 15 in order to achieve a positive suction height. Since the components A, B react with moist air, the respective container 7, 9 and any possible refilling equipment may be arranged in such a way that they do not need to be opened during operation or refilling. Each of the containers 7, 9 may be made in steel. They may also be arranged with a manhole at the top. The manhole may be arranged such that it in a closed position does not let moisture into the container 7, 9, the manhole may e.g. be sealed by means of an o-ring. A breathing filter may be mounted on the manhole. The breathing filters may be arranged with two check valves integrated in such a way that there must be a overpressure in the container 7, 9 in order for air to flow out of the container 7, 9 as well as an under-pressure for ambient air to flow into the container 7, 9. A choke nipple and a check valve may be mounted on the manhole in order to limit the flow and keep the air in the containers 7, 9.

The air may be fed into the containers 7, 9 as soon as the pumps 13, 15 are to be run and may continue to be flushed through the container 7, 9 by blowing out through the check valve and filter of the breathing filter. This will reduce the risk of potential condensation arising in the container 7, 9. The containers 7, 9 may preferably be at an overpressure. The overpressure ensures that moist air is not drawn into and condensed in the containers 7, 9 e.g. at times of cooling of the containers 7, 9 at e.g. night-time. The overpressure may e.g. be 0.35 bar.

According to some embodiments the system 100 further comprises pressure sensors 21, 23 arranged in the respective cannel 1, 3 and arranged to continuously measure the pressure in the respective channel 1, 3. The respective pressure sensor 21, 23 may preferably be arranged between the pump 13, 15 and the flow meter 17, 19 in the respective channel 1, 3. The pressure sensors 21, 23 may thus be arranged downstream the containers 7, 9 and the pumps 13, 15 in the flow direction of the components in the respective channel 1, 3 but upstream the respective flow meter 17, 19. The signals from the pressure sensor 21, 23 may be used as direct information of the pumping pressure prevailing at the injection, but may also be used for fault detection.

According to some embodiments the control unit 25 may be configured to detect a first fault in the system 100 if the pressure which is measured in any of the channels 1, 3 exceeds a pre-determined third threshold.

If the pressure increases sharply in any of the channels 1, 3 this constitutes an indication of a fault in the system, e.g. a clogging in one of the channels 1, 3 or in the mixer 11. Depending on whether the pressure is increasing in both channels 1, 3 or only in one of them, a potential clogging may be localized to a specific channel 1, 3 or the mixer 11. The pressure during operation may be stored or logged over time. The pressure during operation may be compared between different injection cycles, i.e. the pressure at one injection may be compared to the pressure at a different injection. Wear and building up of hardened component A, B in the channels 1, 3 and mixer 11 after prolonged use may lower the efficiency of the system. An increased operational pressure may be an indication of this. A pressure in the system 100 during operation which exceeds a certain threshold may thus be an indication that the mixer 11 is in need of change and/or that the system 100 is in need of cleaning. The threshold for this may e.g. be 150 bar. According to some embodiments the pumps 13, 15 may be turned off at a critical pressure in order to avoid system failure. The critical pressure may e.g. be 200 bar.

According to some embodiments the control unit 25 may be further configured to detect a second fault in the system 100 if the pressure which is measured in any of the channels 1, 3 during a pre-determined time interval increases above a pre-determined fourth threshold at the same time as the flow measured in the same channel 1, 3 is essentially constant or is decreasing.

If the pressure is increasing in any of the channels 1, 3 at the same time as the flow is not increasing, or is even decreasing, then this is an indication that the channel 1, 3 and/or the mixer 11 is beginning to clog up, i.e. that the components A, B or component mixture have gotten caught and hardened in the channel 1, 3 and/or the mixer 11. Comparing the pressure with the flow provides a more robust indication of a fault in the system 100 compared to only monitoring the pressure. Even the parameters related to the operation of the pump which are monitored may be compared to pressure and flow in the channels 1, 3 in order to detect a fault in the system 100.

By detecting faults in the system 100 actions may be taken before the functioning of the system is deteriorated. The injection may e.g. be aborted and the system be cleaned before the rock reinforcement is initialized again. Faults in the system 100 may influence the flow conditions and may lead to an inferior component mixture hardening in the rock hole 5. By detecting faults in the system it is thus achieved that the quality of the mixture can be ensured.

The system 100 may be arranged on a vehicle or a rig. The rig may be mobile such that the system 100 may move within a rock or a tunnel, or between different tunnels in a rock. When the system 100 is mounted on a rig, a control system integrated on the rig, also referred to as a Rig Control System (RCS), may be used as a control unit for controlling the system.

With the term channels 1, 3 is herein meant at least those parts of the system 100 which is located between the containers 7, 9 and the mixer 11 in which the components A, B are transported to the rock hole 5. The channels in the injection adapter may thus comprise a part of the channels 1, 3 described herein. The channels 1, 3 may e.g. comprise hoses. The inner tubes of the hoses may preferably be arranged in materials which are resistant to the components which are to flow through the tube. The material may e.g. be Polytetrafluoroethylene (PTFE) or Polyurethane.

The pumps 13, 15 may for e.g. be hydraulic pumps, electric pumps, air driven pumps or a type of pump where a pre-determined amount of component A, B is pumped. The pumps 13, 15 may herein also be referred to as injection pumps or resin pumps. The pumps 13, 15 may be entirely separated from each other and individually driven by a respective motor, where the motor may be of the type hydraulic motor. The pump 13, 15 and the motor can be mounted as a unit. The pumps 13, 15 may be similar to an ordinary hydraulic pump but may be adapted with a special internal coating adapted for the components A, B. The pumps 13, 15 may also be adapted by not having any pressure compensation as ordinary hydraulic pumps have. This may be done since the control is to be performed in response to the flow in the channels. The motor driving the pump 13, 15 may be a traditionally constructed hydraulic motor and drive the pump 13, 15 through a female spline in order to quickly be changed for easy repair in the field.

A shaft packing may be arranged between motor and pump 13, 15. The shaft packing may in certain cases leak or when at an under-pressure on the inside suck in air which may result in that the components A, B which are being pumped reacts with the moist air by crystallizing and hardening. To ensure a long life span of the shaft packing the pump 13, 15 may be mounted downwards and the hydraulic motor upwards. In this way it is avoided that component liquid A, B flows down into the motor. A glass cup with a refilling lid may be arranged on the distance piece. The glass cup may be filled to a certain level with a liquid. The liquid will then act as an interface and keep air away from the shaft packing. The liquid is preferably a liquid which does not react with any of the components A, B. The liquid may e.g. be motor oil.

The hydraulic motor may be internally drained. The return pressure from the motor may in certain cases not exceed 10 bar during operation. The hydraulic motor and the pump 13, 15 may have different displacement, e.g. 14 cc or 11 cc respectively, which amongst other things provides the benefit that it is easier to control the rotational speed during load of the pump 13, 15 using relatively common hydraulic valves. The rotational speed during operation may in some embodiments not fall below the lowest rotational speed of the pump 13, 15 since it affects the life span of the units. The pumps 13, 15 are therefore according to some embodiments turned off if the rotational speed of the pump 13, 15 falls below a certain threshold. This threshold may e.g. be 240 rpm.

Each hydraulic motor may receive its hydraulic flow from a directional valve. The directional valve may e.g. be a NG6 proportional directional valve. The valve may be an electrically controlled variable choke and the flow through it may be dependent on the current to it and the pressure fall over it. The valve may e.g. be monitored and controlled by a current regulator. The valve may have a slide which e.g. provides 7 litre per minute at 10 bars pressure head. A pressure reducing valve may be mounted before the valve in order to limit the feeding pressure. A low pressure to the motor results in a lower moment for driving the pump 13, 15 which results in a limitation of the maximum pump pressure.

A medium may be pressed into the respective channel 1, 3 upstream of the mouth where the components A, B meet in order to minimize the risk that the components A, B come into contact with each other between pumping operations or injections. If check valves are mounted on the channels the medium may be pressed into the channels 1, 3 between the check valve and the mouth where the components A, B meet. The medium may e.g. be a grease, preferably a lubricant. The medium presses the components A, B in front of itself and drives the components A, B out of the channels in order to prevent hardening and thereby resulting clogging of the channels in the injection adapter and the mixer 11. The medium may also be used as a barrier in the channels between different component injections, which prevents the components from flowing in the wrong direction and coming into contact with each other. The medium may in this case be referred to as a blocking medium.

Figure 3A:
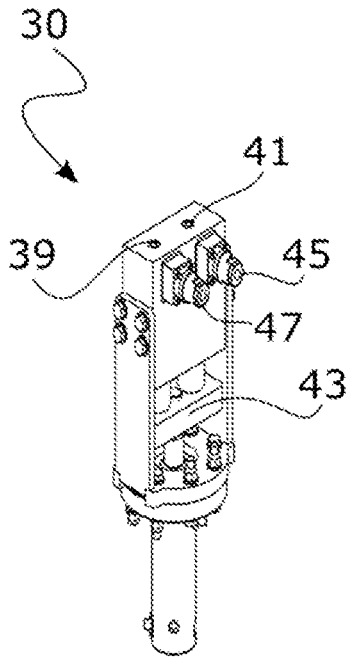
FIG. 3*a* shows a perspective view of a medium pump 30 for use in rock reinforcement.
Figure 3B:
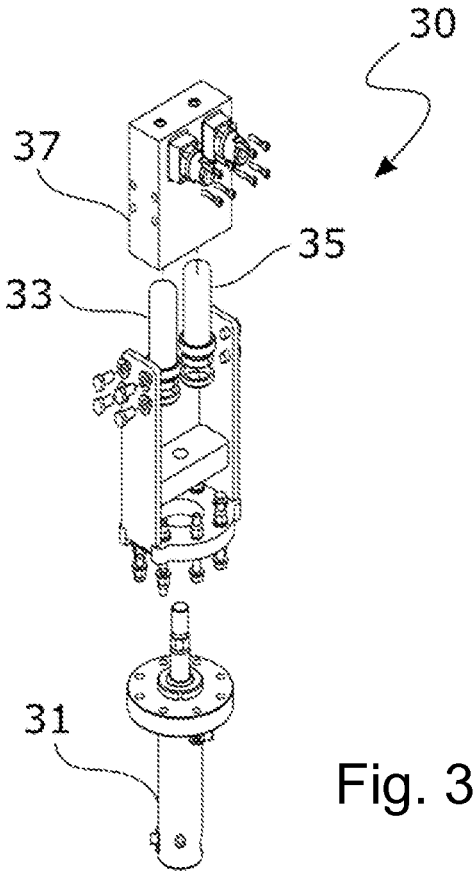
FIG. 3*b* shows an exploded view of the medium pump 30.

FIGS. 3*a* and 3*b* illustrates a device 30 arranged for injecting medium in channels arranged for flow of resin components or molding components in conjunction with rock reinforcement. As have been described above, the medium may e.g. be grease, therefore the device may also be referred to as a grease pump or medium pump. The device 30 may e.g. be arranged for injecting medium in the channels 1, 3 in the system 100 as described herein. The device 30 may be filled with medium. The device 30 may for this purpose comprise at least one, but preferably two, containers or volumes (not shown) for storing of medium. The device may comprise means arranged for measuring the filling level of medium in the device 30. With filling level is herein meant the amount of medium in the device 30 in relation to the amount of medium the device 30 may potentially accommodate. A sensor for measuring the level may e.g. be built into the device 30. An external length sensor may alternatively be arranged to measure the level in the container or volume. When the device 30 is arranged to inject medium in systems where the pumps for component flow are controlled by a control unit, then the control unit may be configured to receive information regarding the filling level of medium in the device 30. The control unit may further be configured to control the pumps in such a way that they are only allowed to pump the respective component trough the respective channel if the filling level of the medium in the device 30 exceeds a pre-determined threshold.

When the device 30 is arranged to inject medium in the channels 1, 3 in the system 100, then the control unit 25 is thus configured to control the pumps 13, 15 so that they are only allowed to pump the respective component A, B through the respective channel 1, 3 if the filling level of medium in the device 30 exceeds a fifth threshold. The pre-determined threshold is determined such that the amount of medium is sufficient to act as a barrier in the channels so that the components are not mixed. The threshold may be all values from 1% of completely full level up to 100% of completely full level.

When the device is arranged to inject medium in the channels 1, 3 in the system 100, the device 30 may be arranged to, after the pumps 13, 15 have stopped pumping, inject medium in the system 100 in order to press remaining components A, B out of the system 100, as well as thereafter being filled with medium.

The medium pump 30 may thus be arranged to inject medium in channels that are used in conjunction with rock reinforcement, e.g. in conjunction with the system 100 as have been described herein. By only allowing injection of molding components in the rock hole when the medium pump 30 is filled with medium to a sufficient level, it can be ensured that the channels and eventual mixer can be flushed through by medium directly after a completed component injection, so that no remaining component may set in the channels or in the mixer. Thereby it may be ensured that the flow through the channels and eventual mixer in the system will be optimal at the next injection, which will lead to an increased quality of the mixture. For the system 100 described herein it will also lead to a reduced need of controlling by the pumps which will lead to a reduced wear on them. With sufficient level is herein meant that the amount of medium is sufficient to press out remaining component out of the system and/or that the amount of medium is sufficient to act as a barrier in the channels so that mixing of the components is avoided.

By directly after completion of component injection injecting medium in the system and press the remaining components and mixture thereof out of the system it may be ensured that no component is left in the system which may harden in the system. By thereafter furthermore fill the medium pump 30 with medium it is ensured that the system is ready to once again inject components into the rock hole.

As has been described above, the device or medium pump 30 may comprise at least one, but preferably two containers, spaces or volumes for storing of medium. A hydraulic cylinder 31 may be used to press out medium from the medium pump 30 by pressing on two plunger pistons 33, 35 which are mounted in a common block 37, also called medium block or grease block. The cylindrical volumes of the plunger pistons 33, 35 do in this case constitute the containers for medium of the device. Medium which is filling up the cylindrical volumes of the plunger pistons 33, 35 are then pressed out of the medium pump 30 through a respective outlet 39, 41.

Channels or tubes may be connected to the outlets to lead medium to the channels which are to be flushed through or blocked. The medium may e.g. be pressed from the medium pump 30 via two separate tubes which lead from the outlets 39, 41 in the medium pump 30 to the channels of an injection adapter. Thereby it is ensured that the respective component channel of the injection adapter receives the same amount of medium. The risk of the medium only being pressed out through one of the channels, which would not provide an adequate cleaning, is then minimized.

In the case when only one container for medium is arranged in the medium pump 30 only one plunger piston is arranged to press out the medium. Furthermore, only one outlet is arranged on the medium pump 30 and only one channel leads from the single outlet.

The hydraulic cylinder 31 may press on the plunging pistons 33, 35 through abutment with a yoke 43. The hydraulic cylinder 31 may be double acting or single acting. There may be two hydraulically controlled valves 45, 47 arranged on the medium block, which though a common hydraulic control and a common feeding of medium fills up the cylindrical volumes of the plunging pistons 33, 35 by pressing the pistons 33, 35 outwards and thereby pressing the hydraulic cylinder 31 together. The medium may be fed through pumping from external containers via the valves 45, 47 to the medium pump. The hydraulic cylinder may in double acting operation suck medium from the external containers via the valves 45, 47 into the medium pump. The valves 45, 47 may in certain cases be pilot controlled, i.e. the valves 45, 47 may in a known manner be indirectly controlled by a smaller pilot valve. Activation of the valves 45, 47 and the hydraulic cylinder 31 respectively, may be performed by a common NG6 directional valve which entails filling of medium in the medium pump 30 when one of the spools is activated and discharging of medium from the medium pump 30 when the other spool is activated, e.g. discharge out of the medium pump 30 and injection into the channels 1, 3 when the medium pump 30 is arranged in the system 100. A pressure reducer may be mounted before the directional valve in order to limit the pressure on the medium out to the injection adapter. When a hydraulic cylinder 31 is used the filling level may be measured by determining or measuring the position of the piston of the hydraulic cylinder 31. The position of the piston determines the position of the plunging pistons 33, 35 and thereby how great an amount of medium which has been pressed into the medium pump. The cylindrical volumes of the plunger pistons 33, 35 are the greatest at the outermost position of the piston and the filling level of the medium pump is therefore 100%. The measurement of the position of the piston may e.g. be performed by an inductive sensor.

The system 100 may e.g. be constructed to be able to use so called spiral mixers or X-mixers. These are in different dimensions but may be placed in the same manner in a hydraulic tube with pressed couplings for mounting directly to a bolt injection nozzle, also referred to as a bolt injection nozzle. Other types of mixers or component mixers may also be used. By allowing the medium from the injection adapter to press the components in front if itself through the channels in the injection adapter and also further through the mixer it may be reused several times.

The system 100 may comprise more than two containers 7, 9. In this way more than two components A, B may be used. The system 100 may also in that case have a corresponding amount of extra channels, pumps, flow meters and pressure sensors arranged, i.e. if three containers with three components are mounted on the system 100, then the system 100 will be arranged with three separate channels having three separate and individually controllable pumps arranged, as well as three flow meters for measuring the flow in each channel. Three pressure sensors may furthermore in that case be arranged, one for each channel. The three channels will then converge in the mixer for mixing of the components. Several different combinations of component mixtures may be used in the same rock hole, e.g. a first mixture comprising two components is first injected in the rock hole, whereupon a second mixture comprising two components, where at least one of the components in the second mixture differs from the components in the first mixture, is injected in the rock hole. The different mixtures may have different properties, such as e.g. setting time.

Each container 7, 9 may also comprise a level glass for ocular level control of the contents of the container 7, 9. A bottom plug and a temperature sensor may be arranged in the lower part of the container 7, 9. A pipe, herein referred to as a suction pipe, extending down to the bottom of the container may be arranged in the manhole of the container 7, 9. An ultrasound sensor may also be arranged in the manhole. The ultrasound sensor may be used to measure the level in the container 7, 9 and may be used both for showing the level of liquid in the container 7, 9 but also for controlling the refilling pumps such that overfilling and leakage is prevented. A temperature sensor and a bottom plug may be arranged in the bottom of the container 7, 9.

Filling of the containers 7, 9 may e.g. be performed "backwards" via the suction pipe, in order to minimize the risk of air being mixed in which may occur when filling or pouring towards an open surface. The filling may thus be performed via the suction pipe to the bottom of the container 7, 9, under the level of any eventual remaining component liquid. When the level is increased a corresponding air volume is pressed out via the breathing filter. A safety valve may be mounted on the container lid or manhole in order to ensure that the pressure in the container 7, 9 does not, for any reason, become too high. The safety valve may be equipped with a lever by which the functioning of the valve may be manually tested.

The system 100 may further comprise two or more refilling pumps for refilling of component liquids A, B to the containers 7, 9 from external containers (not shown). The refilling pumps may e.g. be air driven, hydraulic or electrical. The external containers may be large containers or tanks standing stationary and may be arranged with moisture absorbing breathing filters and a quick coupling on a bottom tap or on the top lid arranged on the respective container. The external containers may also be arranged with a protective plug with a grease nipple. The rock hole may in certain embodiments be filled with components A, B directly from the external containers, i.e. the external containers may be connected via channels directly to the rock hole 5. According to some embodiments the valves may be arranged to be able to guide the component liquid A, B from the external containers to the containers 7, 9 or directly into the channels 1, 3. The valves may e.g. be adjustable three-way valves. In this way a flexible system is achieved where large volumes may be pumped directly from the external containers into a rock hole and where the smaller containers 7, 9 may be used when rock reinforcement need to be performed in smaller spaces where the external containers do not fit. The external containers and the containers 7, 9 may be quickly connected together or disconnected by connecting channels or tubes via quick couplings.

The valves and quick couplings may also be used in order to clean the system in an easy manner. Containers containing cleaning liquid may be connected to the valves via channels or tubes whereupon cleaning liquid may be flushed through the system 100. Depending on the need for cleaning it may furthermore be controlled, via the valves, to which part of the system 100 cleaning liquid shall flow. The cleaning liquid my thus be guided through the containers 7, 9 and into the channels 1, 3 or directly into the channels 1, 3. However, the containers 7, 9 are not ordinarily cleaned, instead the valves guides the cleaning liquid directly to the channels 1, 3. The refilling pumps may be used when cleaning, but separate cleaning pumps are also possible to be used.

A valve may also be placed downstream of the mixer 11. The valve may via channels or tubes lead to a container for flushing residues. The container may be referred to as recycling container or recycling tank. The cleaning liquid may in that case after having flowed through the channels 1, 3 and the mixer 11 be guided via the valve to the container where flushed out residues as well as cleaning liquid is collected. In this way it is avoided that the cleaning liquid as well as the flushed out residues are led to the rock hole 5 or into a bolt which may potentially be placed there.

The refilling pumps may be double acting with two membranes which alternatingly suck from a common suction connection. The respective membrane may suck via its own check valve and press liquid out through its respective check valve to an outlet port. In other words, each refilling pump may in practice correspond to two pumps which provide a measure of redundancy if problems arise. The refilling pumps may be made out of plastic.

The refilling pumps may be driven by a linear air motor and be fed with pressurized air via its respective electrical valve. When the system 100 is arranged on a rig, the pressurized air may be provided by a pressurized air system arranged on the rig. The refilling pumps may be controlled individually and have a common air feed via a pressure reducer. The pressure reducer may be used to indirectly control the flow of the refilling pumps. The air pressure and thereby the speed of the refilling pumps may be adjusted during operation by a set screw. The pressure may be read on a manometer mounted on the valve.

For refilling of the containers 7, 9 of the system a tube-holder may be arranged on the front part of the pumping unit where e.g. 10 meters of the respective component liquids A, B suction tube may be wound. The tubes may be arranged with quick couplings which in a parked mode are locked to corresponding quick couplings which are fixedly mounted. One of the suction tubes may be equipped with a quick coupling male connector and the other with a quick coupling female connector.

In order to ensure that the valve plate in the quick couplings do not get stuck a grease nipple may be mounted in the parking couplings. When the suction tubes have been coupled a smaller amount of grease may be pressed in through the grease nipple which will then be pressed into the quick coupling and press away component liquid from the valve plate. The cone is removed from the quick coupling in order for grease to be able to be applied around the cone in the female when grease is pumped in. The cone in the female will close when the pumping of grease via the nipple is stopped. The female is modified in a corresponding manner and a grease nipple is mounted in its threaded connector.

There is a risk of dirt penetrating into the system when connecting and handling the external tanks and the long suction tubes or channels. The system 100 may therefore be constructed to minimize the amount of dirt in the components in the containers 7, 9. This may be achieved by two pressure filters being mounted between the membrane pumps and the containers 7, 9. The filter may be mounted in a filter container in a filter house. During refilling the membrane pumps will press the components through the respective filter. The filter will remove particles having a size which is harmful for the component injection pumps 13, 15 and the flow meters 17, 19. The filter may be made out of fine meshed acid proof stainless steel which removes particles having a size above 20 μm. The respective filter container may have a drainage tap in the bottom in order to drain the filter house and minimize leakage of the components when filter change is performed.

A method for ensuring the quality of the component mixture will now be described with reference to FIG. 2. Method steps which are optional are indicated by dashed lines in the figure.

Figure 2:
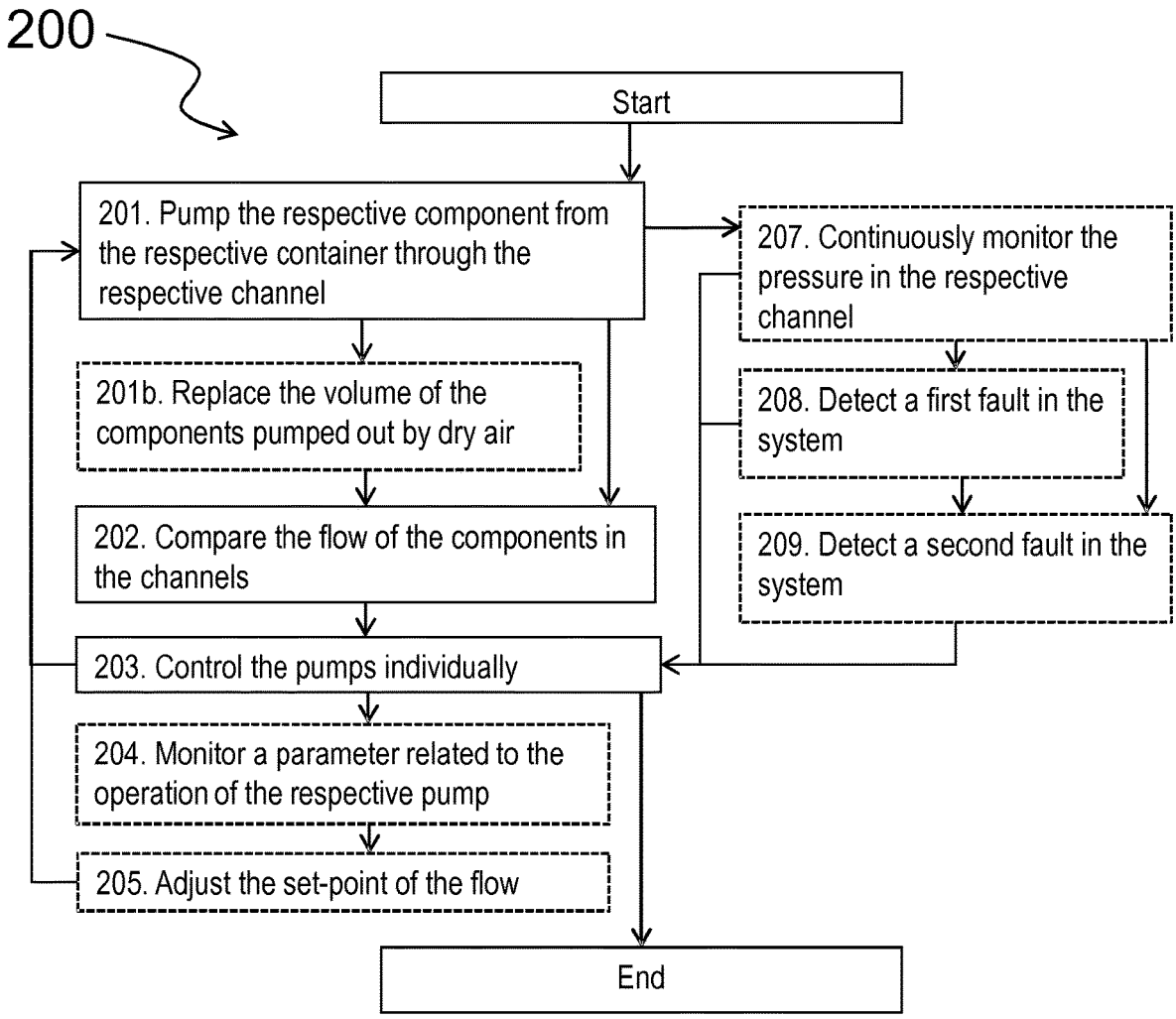
FIG. 2 shows a flow chart illustrating a method 200 in rock reinforcement.

FIG. 2 illustrates an exemplifying method 200 for ensuring the quality of a multi-component mixture comprising at last two components, in a system 100 for rock reinforcement wherein the system 100 comprises a first and a second channel for a respective first A and second B component intended for injection in a rock hole, wherein the respective channel comprises a pump and a container intended for the respective component. The method may e.g. be performed by a control unit 25.

In order to be able to ensure the quality of the multi-component mixture the system 100 need to obtain information regarding the flow ratio in the channels and control the pumps depending on to this information. The method 200 comprises: to pump 201 the respective component from the respective container through the respective channel. Continuous comparison 202 of the flow of the first component in the first channel with the flow of the second component in the second channel. Controlling 203 the pumps individually, based on the comparison of the flows, in such a way that a deviation from a pre-defined volume ratio between the first component A and the second component B in the mixture is below a pre-defined first threshold.

The method progresses until the rock hole 5 has been filled with component mixture, alternatively until the rock reinforcement need to be aborted, e.g. if a serious fault has been detected.

According to some embodiments the step 203 may further comprise: to also control the pumps according to a set-point of the flow of the components.

According to some embodiments the method 200 may further comprise: to monitor 204 a parameter related to the operation of the respective pump.

According to some embodiments the method may further comprise: to adjust 205 the set-point of the flow when at least one of the monitored parameters coincides with a pre-determined second threshold.

The adjusted set-point of the flow will thereafter form the basis for the continued pumping and control of the pumps 13, 15.

According to some embodiments the method may further comprise when pumping said first A and second B component from the respective container: to replace 201*b* the volume of the components which have been pumped out of the respective containers with dry air.

According to some embodiments the method may further comprise: to continuously monitor 207 the pressure in the respective channel.

According to some embodiments the method may further comprise: to detect 208 a first fault in the system 100 if the pressure which is measured in any of the channels 1, 3 exceeds a pre-determined third threshold.

According to some embodiments the method may further comprise: to detect 209 a second fault in the system 100 if the pressure which is measured in any of the channels during a pre-determined time interval increases above a pre-determined fourth threshold at the same time as the measured flow in the same channel is essentially constant or is decreasing.

The pumps may be controlled also based on fault detection. The pumps can be controlled down or up depending on the detection. In case of serious errors, such as e.g. a channel being fully clogged up by residues, the rock reinforcement may be stopped.

According to some embodiments the system 100 comprises a device 30 arranged to inject a medium in the channels 1, 3, which device 30 may be filled with medium. The method may in this case further comprise: to measure the filling level of medium in the device 30, and to pump the respective component A, B through the respective channel 1, 3 only if the filling level of the medium in the device 30 exceeds a pre-determined fifth threshold.

According to some embodiments the method may further comprise, after the pumps 13, 15 have stopped pumping: to inject medium in the system 100 in order to displace remaining components A, B out of the system 100 followed by a refilling of medium in the device 30.

The system and the method which have been described herein are not limited to rock reinforcement with a bolt, instead all manner of rock reinforcements where a molding agent is injected in a rock hole and/or crevices in rocks are possible applications.

The invention claimed is:

1. A method for ensuring the quality of a multi-component mixture comprising at last two components, in a system for rock reinforcement; wherein the system comprises a first and a second channel for a respective first and second component to inject in a rock hole, wherein the respective channel comprises a pump and a container intended for the respective component, wherein the method comprising:

injecting, in a rock hole and using a pump, of the respective component from the respective container through the respective channel, wherein the method further comprising:

continuously comparing the flow of the first component in the first channel with the flow of the second component in the second channel, maintaining a pre-defined volume ratio between the first component and the second component by controlling the pumps individually, based on the comparison of the flows and in such a way that a deviation from the pre-defined volume ratio is below a pre-defined first threshold.

2. The method according to claim 1, wherein the step of controlling the pumps further comprising:

controlling the pumps according to a set-point of the flow of the components, wherein the method further comprising:

monitoring of a parameter related to the operation of the respective pump, adjusting the set-point of the flow when at least one of the monitored parameters coincides with a pre-determined second threshold.

3. The method according to claim 1, wherein the method further comprising, when pumping said first and second component from the respective container:

replacing the volume of the components which have been pumped out of the respective containers with dry air.

4. The method according to claim 1, wherein the method further comprising:

continuously monitoring the pressure in the respective channels.

5. The method according to claim 4, wherein the method further comprising:

detecting of a first fault in the system if the pressure measured in any of the channels exceeds a pre-determined third threshold.

6. The method according to claim 4, wherein the method further comprising:

detecting of a second fault in the system if the pressure measured in any of the channels during a pre-determined time interval increases above a predetermined fourth threshold at the same time as the measured flow in the same channel is essentially constant or is decreasing.

7. A system for ensuring the quality of a multi-component mixture comprising at least two components for use in rock reinforcement, wherein the system comprises a first and a second channel for a respective first and second component to inject in a rock hole, wherein the respective channel comprises a pump and a container intended for the respective component, wherein said pumps pump the respective component from the respective container, into a rock hole, through the respective channel wherein the system further comprises a flow meter arranged in the respective first and second channel, a control unit configured to continuously compare the flow of said first component in said first channel to the flow of said second component in said second channel, wherein the control unit is further configured to maintain a pre-defined volume ratio between the first component and the second component by controlling the pumps individually, based on the comparison of the flows and in such a way that a deviation from the pre-defined volume ratio is below a pre-determined first threshold.

8. The system according to claim 7, wherein the control unit is further configured to control the pumps according to a set-point of the flow of the components, wherein the system further comprises means for monitoring a parameter related to the operation of the respective pump, wherein the control unit is further configured to adjust the set-point of the flow when at least one of the monitored parameters coincide with a pre-determined second threshold.

9. The system according to claim 7, wherein the system further comprises pressure sensors arranged in the respective channel and arranged to continuously measure the pressure in the respective channel.

10. The system according to claim 9, wherein the control unit is configured to detect a first fault in the system if the pressure which is measured in any of the channels exceeds a pre-determined third threshold.

11. The system according to claim 9, wherein the control unit is further configured to detect a second fault in the system if the pressure measured in any of the channels during a pre-determined time interval increases above a pre-determined fourth threshold at the same time as the flow measured in the same channel is essentially constant or is decreasing.

* * * * *